US005848447A

United States Patent [19]

Lindsay

[11] Patent Number: 5,848,447

[45] Date of Patent: Dec. 15, 1998

[54] TOILET SEAT PIVOTING DEVICE

[76] Inventor: Blair W. Lindsay, 13201 Clayton Road St., Louis, Mo. 63131

[21] Appl. No.: 56,299

[22] Filed: Apr. 7, 1998

[51] Int. Cl.[6] ..... A47K 13/10

[52] U.S. Cl. ..... 4/667; 4/237

[58] Field of Search ..... 4/237, 246.1, 246.3, 4/246.4, 238, 239, 241, 667; 297/DIG. 10, 327, 330

[56] References Cited

U.S. PATENT DOCUMENTS

| | | | |
|---|---|---|---|
| 3,458,872 | 8/1969 | Hellstrom et al. | 4/237 |
| 3,479,087 | 11/1969 | Burke | 4/237 |
| 4,993,085 | 2/1991 | Gibbons | 4/237 |
| 5,661,858 | 9/1997 | House et al. | 4/246.3 |

*Primary Examiner*—David J. Walczak

[57] ABSTRACT

A device for raising and lowering a toilet seat. Such a toilet seat enables the elderly and disabled to more easily use toilets. In its broadest context, the present invention includes a toilet seat which is pivotally secured to the remaining toilet bowl. To the rearward extent of the toilet seat a pair of opposing drive cylinders are secured. Each of the drive cylinders is further threadably interconnected to a drive shaft. Each of these drive shafts is further interconnected to a horizontal drive shaft via a beveled gear assembly. A transverse drive shaft serves to drive the entire assembly and is interconnected to both of the horizontal drive shafts. A motor is interconnected to the transverse drive shaft for use in powering the entire assembly.

3 Claims, 3 Drawing Sheets

TOILET SEAT PIVOTING DEVICE

BACKGROUND OF THE INVENTION

1. Field of the Invention

The present invention relates to a toilet seat lifting device and more particularly pertains to such a seat which is pivotally connected to a toilet bowl.

2. Description of the Prior Art

The use of a hydraulic toilet seats is known in the prior art. More specifically, such toilet seats are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,063,617 to Ward et al discloses a hydraulic toilet seat assembly. U.S. Pat. No. 4,993,085 to Gibbons discloses a power assisted toilet seat apparatus. Design U.S. Pat. No. 278,178 to Loyd discloses a tiltable toilet seat for disabled persons. U.S. Pat. No. 5,440,767 to Bergenwall discloses a device for toilet seats. U.S. Pat. No. 4,833,736 to Sadler discloses a seating assist apparatus. Lastly, U.S. Pat. No. 5,142,709 to McGuire discloses a hydraulic commode assembly.

In this respect, the pivotal toilet seat of the present invention substantially departs from the conventional concepts and designs of the prior art, and in so doing provides an apparatus primarily developed for the purpose of assisting a user onto a toilet seat.

Therefore, it can be appreciated that there exists a continuing need for improved toilet seat elevation devices In this regard, the present invention substantially fulfills this need.

SUMMARY OF THE INVENTION

In view of the foregoing disadvantages inherent in the known types of toilet seat elevation devices now present in the prior art, the present invention provides a toilet seat which is pivotally connected to a toilet bowl. As such, the general purpose of the present invention, which will be described subsequently in greater detail, is to enable a user to more easily use a toilet seat.

To attain this, the present invention essentially comprises a device for raising and lowering a toilet seat. Such a toilet seat enables the elderly and disabled to more easily use toilets. In its broadest context, the present invention includes a toilet seat which is pivotally secured to the remaining toilet bowl. To the rearward extent of the toilet seat a pair of opposing drive cylinders are secured. Each of the drive cylinders is further threadably interconnected to a drive shaft. Each of these drive shafts is further interconnected to a horizontal drive shaft via a beveled gear assembly. A transverse drive shaft serves to drive the entire assembly and is interconnected to both of the horizontal drive shafts. A motor is interconnected to the transverse drive shaft for use in powering the entire assembly.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved device for raising and lowering a toilet seat. The device comprises a toilet bowl having a lower base and an opened upper portion. A pivotal toilet seat is included having a forward open portion, a rearward closed portion, a first side and a second side. The forward open portion is pivotally secured to the toilet bowl. The device further includes two side lifting assemblies. Each of these side lifting assemblies includes a sliding hinge secured to a side of the pivotal toilet seat. Additionally, an internally threaded sleeve is included having an opened lower end and a closed upper end. The closed upper end is slidably secured to one of the sliding hinges. An upwardly extending drive screw is threadably positioned within the internally threaded sleeve such that rotation of the drive screw causing the linear movement of the threaded sleeve. A bevel gear is secured to a lower end of the drive screw. A horizontal drive screw is included which has a forward end with a beveled gear secured thereto, and a rearward end with a rearward gear secured thereto. The beveled gear of the horizontal drive screw is in communication with the beveled gear of the upwardly extending drive screw. Additionally, a transverse drive shaft is included which has a pair of worm gears, with each of the worm gears being connected with one of the two side lifting assemblies. More specifically, a first worm gear is in communication with the rearward gear of the first horizontal drive screw, and the second worm gear is in communication with the other rearward gear of the second horizontal drive screw. Lastly, a motor connected to the transverse drive shaft for use in rotating the transverse drive shaft.

It is another object of the present invention to provide a pivotal toilet seat without the use of hydraulics or other pressurized fluids.

It is a further object of the present invention to provide a pivotal toilet seat wherein the forward portion of the toilet seat stays connected with the remaining toilet seat.

An even further object of the present invention is to provide a pivotal toilet seat which is susceptible of a low cost of manufacture with regard to both materials and labor, and which accordingly is then susceptible of low prices of sale to the consuming public, thereby making such toilet seats economically available to the buying public.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

The present invention relates to a device for raising and lowering a toilet seat. Such a toilet seat enables the elderly and disabled to more easily use toilets. In its broadest context, the present invention includes a toilet seat which is pivotally secured to the remaining toilet bowl. To the rearward extent of the toilet seat a pair of opposing drive cylinders are secured. Each of the drive cylinders is further threadably interconnected to a drive shaft. Each of these drive shafts is further interconnected to a horizontal drive shaft via a beveled gear assembly. A transverse drive shaft serves to drive the entire assembly and is interconnected to both of the horizontal drive shafts. A motor is interconnected to the transverse drive shaft for use in powering the entire assembly. The various components of the present invention, and the manner in which they interrelate, will be described in greater detail hereinafter.

Figure 3:
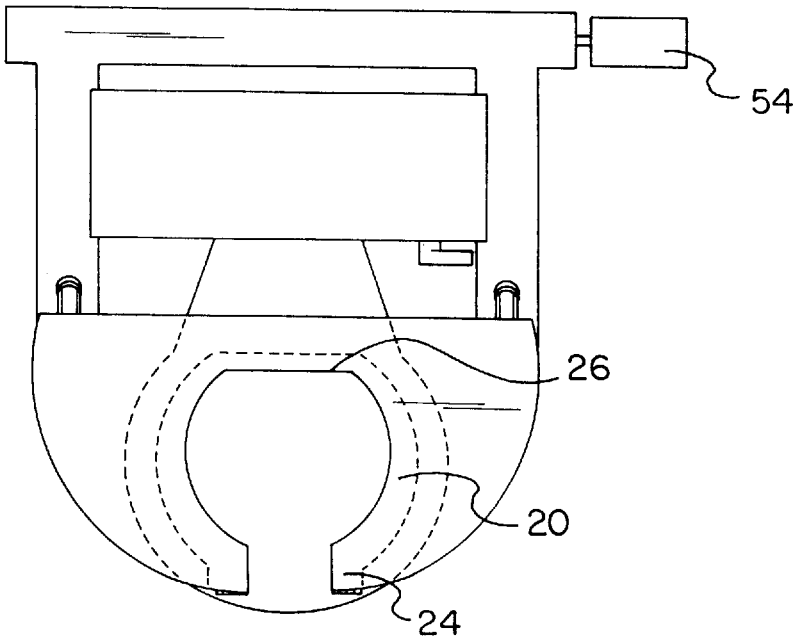
FIG. 3 is a plan view of the toilet seat of the present invention.
Figure 4:
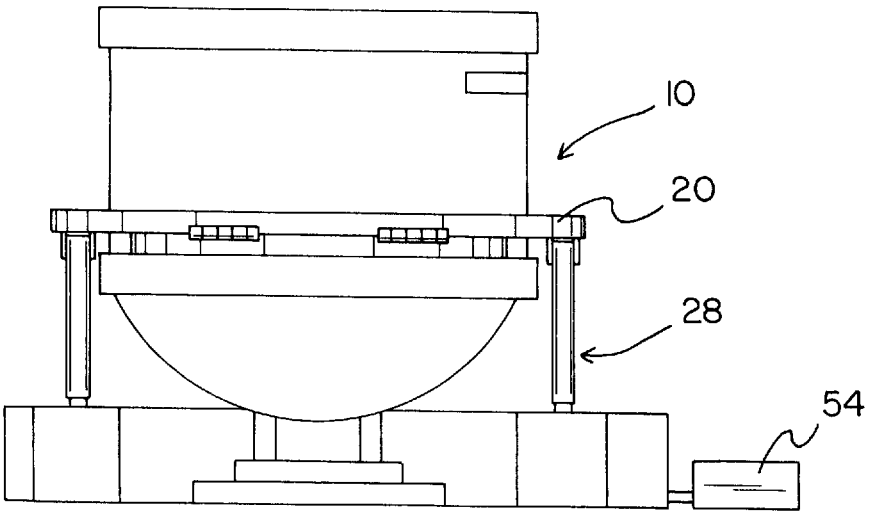
FIG. 4 is a forward plan view of the toilet seat of the present invention.
Figure 5:
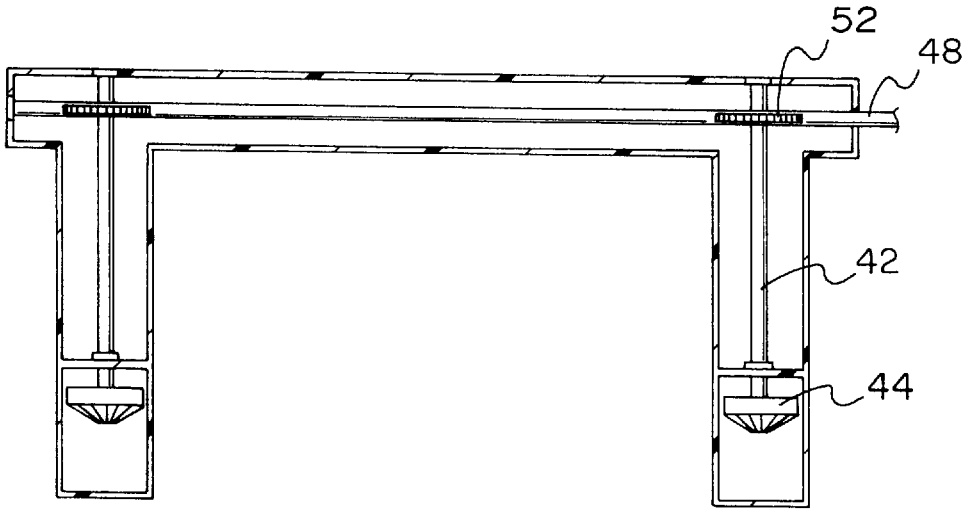
FIG. 5 is a cross sectional view of the drive assembly.

The device 10 of the present invention is employed over a toilet bowl 20. Such a bowl 20 has both a lower base and an opened upper portion. The bowl itself can be of a conventional construction, with the lifting assembly of the present invention fitted about the bowl 20. The pivotal toilet seat 22 of the present invention includes a forward open portion 24, a rearward closed portion 26, a first side and a second side. The forward open portion 24 is pivotally secured to the toilet bowl 20. Specifically, two hinges are employed in securing the two sides of the open portion 24 of the toilet seat 22 to the underlying toilet bowl 20. This arrangement is clearly depicted with reference to FIG. 3.

The toilet seat 22 of the present invention can be pivoted relative to the toilet bowl 20 by way of a pair of lifting assemblies 28. The two lifting assemblies 28 are identical to one another. Consequently, only one such lifting assembly 28 will be described in detail.

Figure 1:
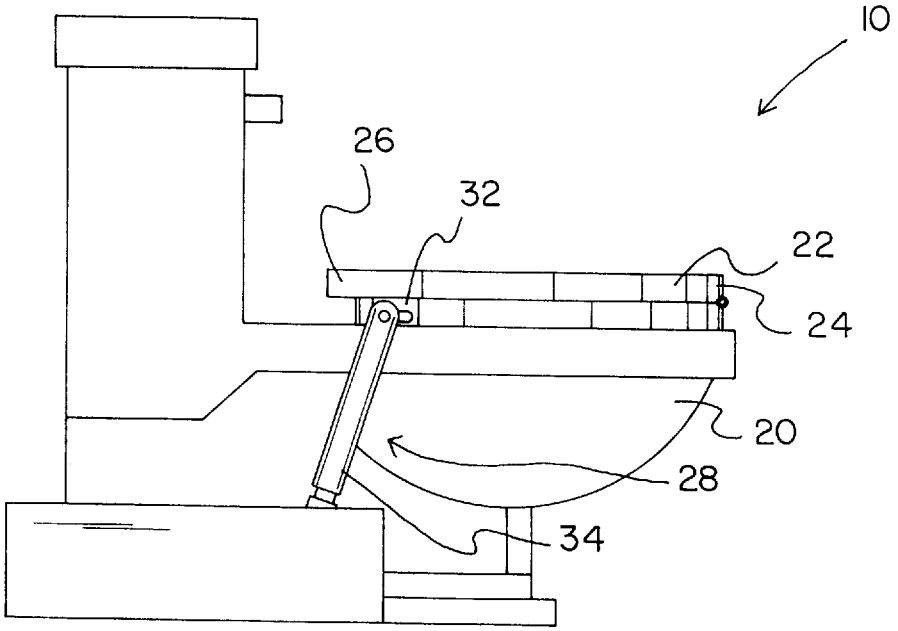
FIG. 1 is an elevational view of the pivotal toilet seat of the present invention.
Figure 2:
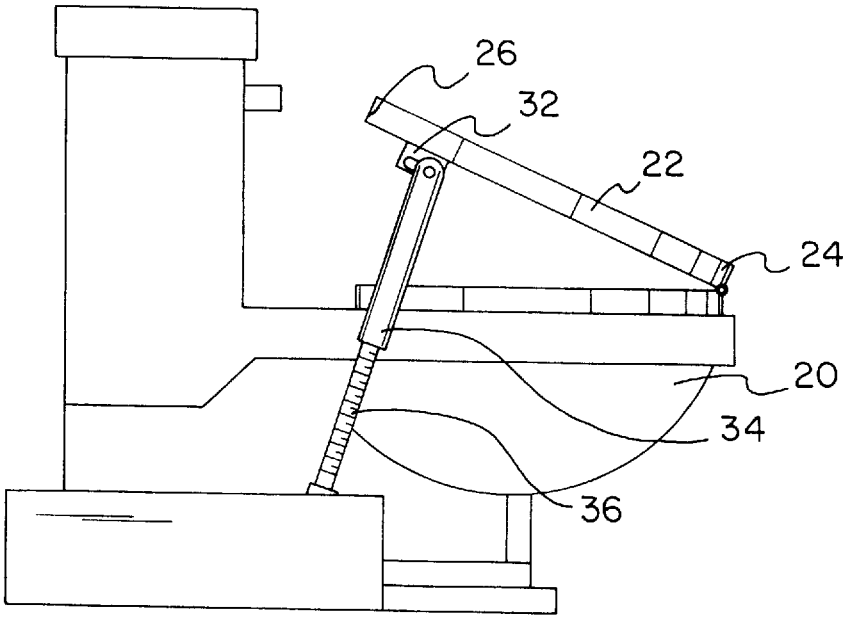
FIG. 2 is an elevational view of the seat in an inclined orientation.

Each of the lifting assemblies 28 includes a sliding hinge 32. Each sliding hinge 32 is secured to a side of the pivotal toilet seat 22, in a manner depicted in FIG. 2. The sliding hinge 32 allows the connection between the toilet seat 22 and the corresponding lifting assembly 28 to slide upon the raising and lowering of the seat 22. Each of the lifting assemblies 28 further includes an internally threaded sleeve 34 having an opened lower end and a closed upper end. The closed upper end is slidably secured to one of the sliding hinges 32, in a manner depicted in FIG. 2.

An upwardly extending drive screw 36 is threadably positioned within the internally threaded sleeve 34. This arrangement is depicted in the cross section of FIG. 6. In this manner the rotation of the drive screw 36 causes the linear movement of the threaded sleeve 34. A bevel gear 38 is secured to a lower end of the drive screw 36 for transferring rotational power from another source to the upwardly extending drive screw 36.

Figure 6:
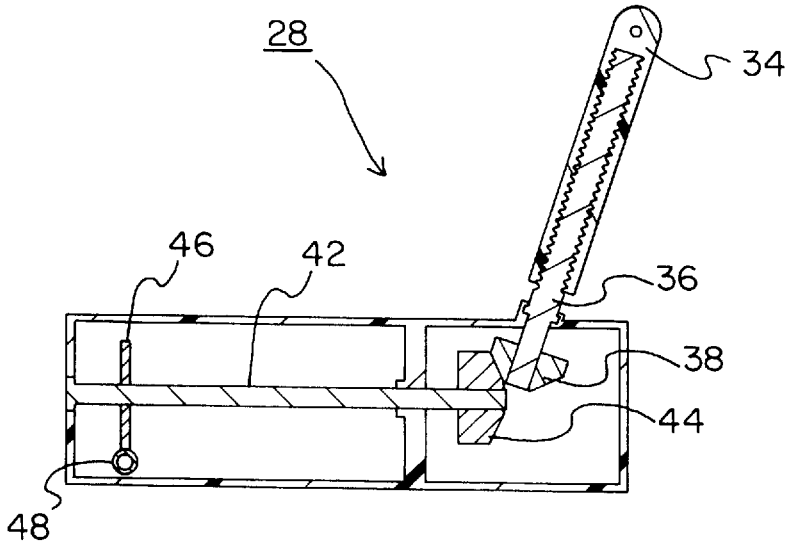
FIG. 6 is a cross sectional view of the horizontal and upwardly extending drive screws of the present invention.

With reference to FIG. 6, the horizontal drive screw 42 of the lifting assembly 28 is depicted. This horizontal drive screw 42 has a forward end with a beveled gear secured thereto 44, and a rearward end with a rearward gear 46 secured thereto. The beveled gear 44 of the horizontal drive screw 42 is in communication with the beveled gear 38 of the upwardly extending drive screw 36. Through this connection rotational power is transferred from the horizontal drive screw 42 to the upwardly extending drive screw 36.

Both of the lifting assemblies 28 are powered via a transverse drive screw 48. The transverse drive screw 48 supports a pair of worm gears 52. Each of these worm gears 52 is connected with one of the two side lifting assemblies 28. More specifically, a first worm gear of the transverse shaft 48 is in communication with the rearward gear of the first horizontal drive screw. In a similar fashion, the second worm gear is in communication with the other rearward gear of the second horizontal drive screw.

A single motor 54 can be connected to the transverse drive shaft 48 for use in rotating the transverse drive shaft. Rotation of the transverse drive shaft, in turn, rotates both worm gears and both horizontal drive shafts. Each horizontal drive shaft, in turn, rotates its corresponding upwardly extending drive shaft. Rotation of the two upwardly extending drive shafts causes the liner movement of the two sleeves. Ultimately, the forward titling of the toilet seat is accomplished. The upwardly inclined seat enables a user to more easily use the toilet facilities.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A device for raising and lowering a toilet seat, the device comprising in combination:

a toilet bowl having a lower base and an opened upper portion;

a pivotal toilet seat having a forward open portion, a rearward closed portion, a first side and a second side, the forward open portion being pivotally secured to the toilet bowl;

two side lifting assemblies, each of the side lifting assemblies comprising:

a sliding hinge secured to one of the sides of the pivotal toilet seat;

an internally threaded sleeve having an opened lower end and a closed upper end, the closed upper end being slidably secured to the sliding hinge;

an upwardly extending drive screw being threadably positioned within the internally threaded sleeve such that rotation of the drive screw causes linear movement of the threaded sleeve, a bevel gear secured to a lower end of the drive screw; and a horizontal drive screw having a forward end with a beveled gear secured thereto, and a rearward end with a rearward gear secured thereto, the beveled gear of the horizontal drive screw being in communication with the beveled gear of the upwardly extending drive screw;

the device for raising and lowering the toilet seat further comprising a transverse drive shaft for operating both of the side lifting assemblies and having a pair of worm gears wherein a first worm gear is in communication with the rearward gear of the horizontal drive screw in one of the side lifting assemblies, the second worm gear is in communication with the other rearward gear of the horizontal drive screw in the other side lifting assembly; and a motor connected to the transverse drive shaft for use in rotating the transverse drive shaft.

2. A device for raising and lowering a toilet seat, the device comprising in combination:

a toilet bowl having a lower base and an opened upper portion;

a pivotal toilet seat having a forward open portion, a rearward closed portion, a first side and a second side, the forward open portion being pivotally secured to the toilet bowl;

two side lifting assemblies, each of the side lifting assemblies comprising:

a sliding hinge secured to one of the sides of the pivotal toilet seat;

an internally threaded sleeve having an opened lower end and a closed upper end, the closed upper end being slidably secured to the sliding hinge;

an upwardly extending drive screw being threadably positioned within the internally threaded sleeve such that rotation of the drive screw causes linear movement of the threaded sleeve, a bevel gear secured to a lower end of the drive screw; and a horizontal drive screw having a forward end with a beveled gear secured thereto, and a rearward end with a rearward gear secured thereto, the beveled gear of the horizontal drive screw being in communication with the beveled gear of the upwardly extending drive screw.

3. A device for raising and lowering a toilet seat as described in claim 2 further comprising:

a transverse drive shaft having a pair of worm gears wherein a first worm gear is in communication with the rearward gear of the horizontal drive screw in one of the lifting assemblies, the second worm gear is in communication with the other rearward gear of the horizontal drive screw in the other side lifting assembly.

* * * * *